US005497939A

United States Patent [19]

Heiskell et al.

[11] Patent Number: 5,497,939

[45] Date of Patent: Mar. 12, 1996

[54] CONTAINER WITH PANEL LOCK

[75] Inventors: Ronald E. Heiskell, Tracy; Ezra E. Theys, San Mateo, both of Calif.

[73] Assignee: Advanced Container Corporation, Tracy, Calif.

[21] Appl. No.: 326,942

[22] Filed: Oct. 21, 1994

[51] Int. Cl.[6] ..... B65D 5/32

[52] U.S. Cl. ..... 229/23 R; 229/109; 229/198.2; 229/915; 229/919

[58] Field of Search ..... 229/23 R, 109, 229/198.1, 198.2, 198.3, 199, 915, 919; 206/503, 508, 509, 511

[56] References Cited

U.S. PATENT DOCUMENTS

| | | | |
|---|---|---|---|
| 3,915,372 | 10/1975 | Crane | 229/23 R |
| 3,935,990 | 2/1976 | Crane | 229/23 R |
| 4,147,289 | 4/1979 | Crane | 206/509 |
| 4,230,233 | 10/1980 | Orr | 229/23 R |
| 4,482,074 | 11/1984 | Lalley | 229/23 R |
| 4,637,544 | 1/1987 | Quercetti | 229/23 R |
| 4,993,623 | 2/1991 | Kelly et al. | 229/23 R |
| 5,038,998 | 8/1991 | Morris et al. | 229/23 R |
| 5,116,290 | 5/1992 | Ross | 229/23 R |

*Primary Examiner*—Gary E. Elkins
*Attorney, Agent, or Firm*—Burns, Doane, Swecker & Mathis

[57] ABSTRACT

A container with a novel locking mechanism for attaching the body of the container to the container end plates. The present invention also provides a container that is totally recyclable without having to disassemble the container. A stackable shipping and storing container is provided comprising a fight side wall, a left side wall, and a bottom wall all extending between a first end wall and a second end wall and having a locking tab near each end. A panel lock is provided for attaching the locking tab of the right side wall, the left side wall, and the bottom wall to the first end wall and the second end wall wherein each locking tab is held in the panel lock at at least three points.

26 Claims, 13 Drawing Sheets

CONTAINER WITH PANEL LOCK

FIELD OF THE INVENTION

The present invention relates generally to a container with a novel locking mechanism for attaching the body of the container to the container end plates. The present invention relates particularly to containers used for shipping and storing fruit, such as table grapes, peaches, apples, and other tree fruit although not limited to such containers. The present invention also provides a container that is totally recyclable without having to disassemble the container.

BACKGROUND OF THE INVENTION

The market for fresh fruit is widespread. Fruit growing areas such as California and Chile use approximately 120 million grape containers and 70 million tree fruit containers per year. Typically, table grapes and tree fruit are packed in layers in shipping containers. A paper liner is used on the bottom and along the sides of the container to prevent damage to the fruit. These containers are typically disposed of after each use.

Fresh fruit such as table grapes requires special handling techniques prior to and during shipment to maintain freshness. Table grapes for example are packed in the shipping containers then the shipping containers are stacked on palettes (typically 60 or 90 containers per palette). The palettes are then placed in a refrigerated warehouse where they are force air cooled (in some instances up to 8 hours). It is desirable to have a container that has sufficient strength to allow the palettes to be stacked three high in the warehouse.

One known type of grape shipping container consists of two wooden end plates with a wood laminated fiberboard panel wrap nailed to the sides and bottom of the wooden end plates to form the container. The lid consists of a fiberboard panel with a wooden strip stapled to each end. The wooden strips on the lid have slots in their edges so that the lid can be attached to the container by sliding the slots under nails extending out of the top of the two wooden end plates. The table grapes can be damaged if they touch the wooden end plates during shipment so a paper liner is added to the inside of the container to protect the grapes. The wooden end plates are very costly and the container can not be recycled without dissembling the container which is costly. In addition, the containers tend to slide around relative to each other during transportation. The sliding of the containers risks damage to the fruit and results in the stacks of containers leaning off the palettes.

Another known type of grape container is a corrugated fiberboard box with a lid that consists of two flaps attached to the sides of the container. The corrugated fiberboard box is folded from one single-layered corrugated panel. The corrugated panel overlaps itself several times at the ends of the box to form multi-layered ends for strength. However, the corrugated fiberboard box can generally only be stacked two palettes high because moisture and the pressure caused by strapping the containers down on the palettes cause the containers to collapse thus damaging the fruit. The grapes packed in corrugated fiberboard containers also typically have to be force air cooled for longer periods of time because of the insulating nature of the corrugated fiberboard. The corrugated fiberboard box has stacking tabs on each end to try to prevent sliding of the containers relative to each other. But these tabs are of limited use because moisture tends to cause the tabs to weaken. The corrugated fiberboard is sometimes passed through shower of wax that provides some degree of water repellency. However, the corrugated fiberboard box is not recyclable because of the wax added to the fiberboard.

A third known type of grape container consists of injection molded polypropylene end plates with a fiberboard panel nailed to the sides and bottom of the end plates similar to the wooden end plate container. Likewise, the lid attaches in the same manner. The injection molded end plates are less expensive than the wooden end plates, however the container can not be recycled without dissembling the container to separate the nails from the plastic end plates which is costly. In addition, the containers tend to slide around relative to each other during transportation risking damage to the fruit.

There is a continuing and long-felt need to provide a cost-efficient fruit container that can be stacked at least three palettes high without leaning or collapsing. In addition, it is desirable to have a fruit container that is completely recyclable without having to disassemble the container.

SUMMARY OF THE INVENTION

The present invention, generally speaking, provides a shipping and storing container. The container is adapted to be stacked on top of a similar container with minimal relative movement of the stacked containers during cold storage and transportation. In addition, the container is manufactured from recyclable material with a novel locking feature that allows the container to be recycled without having to disassemble the container.

In accordance with one embodiment of the present invention, there is provided a stackable shipping and storing container, comprising a first end plate having a stacking tab extending vertically from a top of the first end plate, having a receiving slot at a bottom of the first end plate for receiving a stacking tab of a substantially identical second stackable container, and having a plurality of panel locks on a first edge, a bottom edge, and a second edge of the first end plate; a second end plate having a stacking tab extending vertically from a top of the second end plate, having a receiving slot at a bottom of the second end plate for receiving a stacking tab of a substantially identical second stackable container, and having a plurality of panel locks on a first edge, a bottom edge, and a second edge of the second end plate; and a panel attached at a first end to the first end plate and at a second end to the second end plate with the plurality of panel locks.

In accordance with another embodiment of the present invention there is provided a stackable shipping and storing container, comprising a first end wall; a second end wall; a right side wall extending between the first end wall and the second end wall and having a locking tab near each end; a left side wall extending between the first end wall and the second end wall and having a locking tab near each end; a bottom wall extending between the first end wall and the second end wall and having a locking tab near each end; and locking means for attaching the locking tab of the right side wall, the left side wall, and the bottom wall to the first end wall and the second end wall wherein each locking tab is held in the locking means at at least three points.

In accordance with yet another embodiment of the present invention there is provided a stackable shipping and storing container, comprising a first end wall having a stacking tab extending vertically from a top of the first end wall, having a receiving slot at a bottom of the first end wall for receiving a stacking tab of a substantially identical second stackable container, and having at least one protrusion near a first edge, a bottom edge, and a second edge of the first end wall; a second end wall having a stacking tab extending vertically from a top of the second end wall, having a receiving slot at a bottom of the second end wall for receiving a stacking tab of a substantially identical second stackable container, and having at least one protrusion near a first edge, a bottom edge, and a second edge of the second end wall; a left side wall having an opening at a first end and a second end, the protrusion near the first edge of the first end wall protruding through the opening at the first end of the left side wall to secure the left side wall to the first end wall, the protrusion near the first edge of the second end wall protruding through the opening at the second end of the left side wall to secure the left side wall to the second end wall; a bottom wall having an opening at a first end and a second end, the protrusion near the bottom edge of the first end wall protruding through the opening at the first end of the bottom wall to secure the bottom wall to the first end wall, the protrusion near the bottom edge of the second end wall protruding through the opening at the second end of the bottom wall to secure the bottom wall to the second end wall; and a right side wall having an opening at a first end and a second end, the protrusion near the second edge of the first end wall protruding through the opening at the first end of the right side wall to secure the right side wall to the first end wall, the protrusion near the second edge of the second end wall protruding through the opening at the second end of the right side wall to secure the right side wall to the second end wall.

BRIEF DESCRIPTION OF THE DRAWINGS

Many objects and advantages of the present invention will be apparent to those of ordinary skill in the art when this specification is read in conjunction with the attached drawings. The invention will now be described with reference to the accompanying drawings wherein like reference numerals are applied to like elements and wherein.

DETAILED DESCRIPTION OF THE INVENTION

Figure 1:
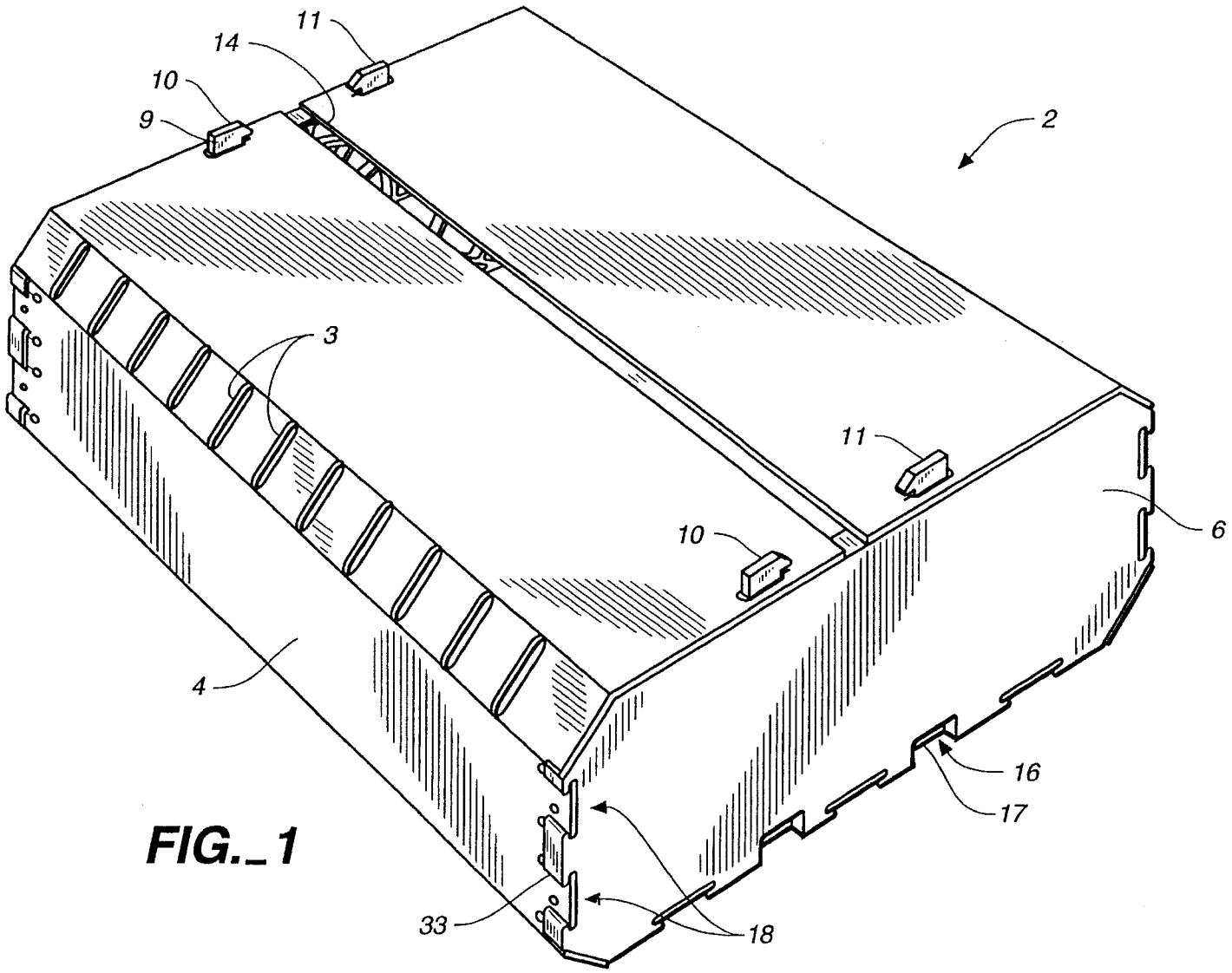
FIG. 1 is an isometric view of one embodiment of a stackable storing and shipping container in accordance with the present invention.
Figure 3:
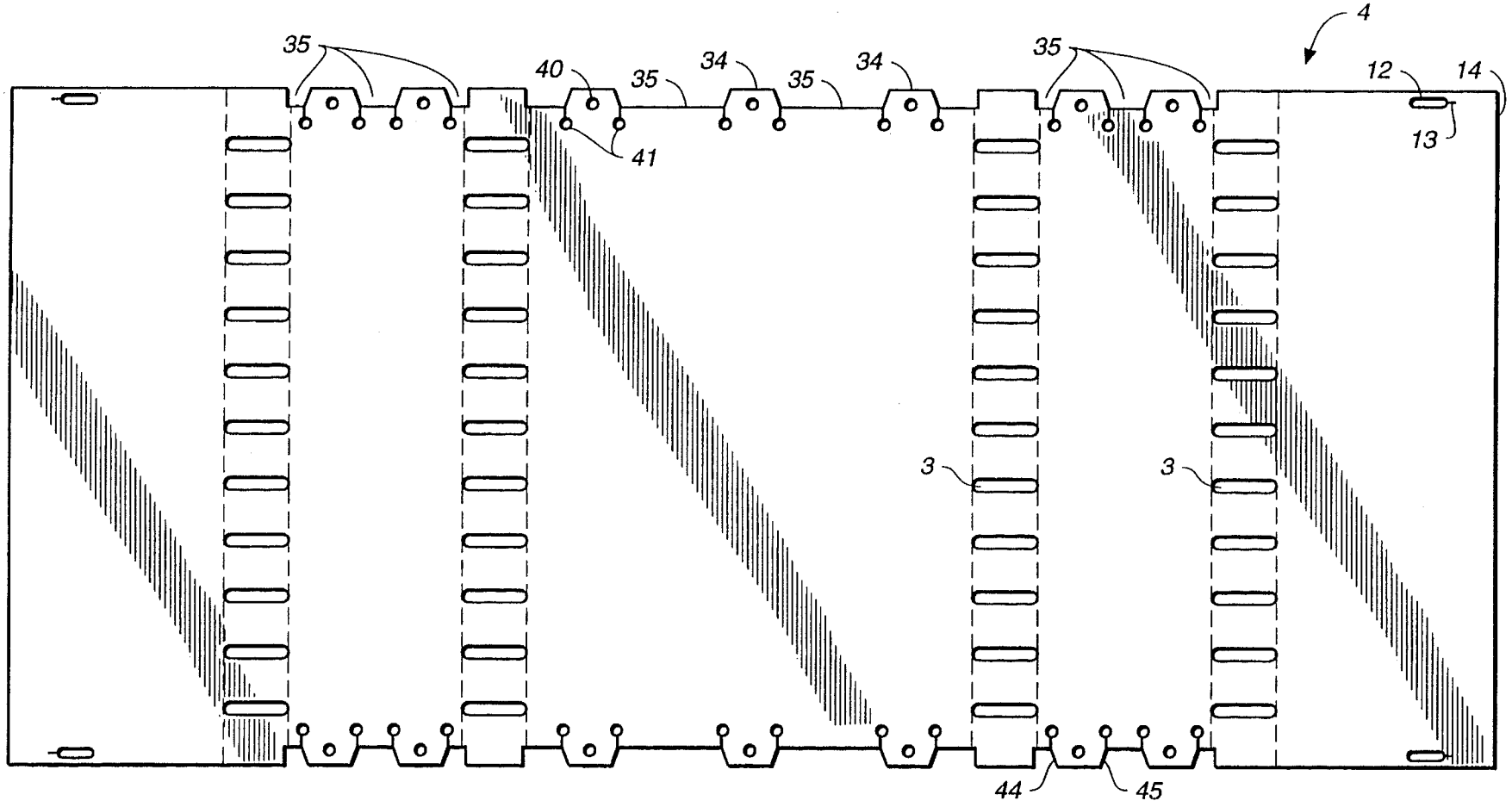
FIG. 3 is a plan view of one embodiment of a panel used to construct the stackable container of the present invention.
Figure 3A:
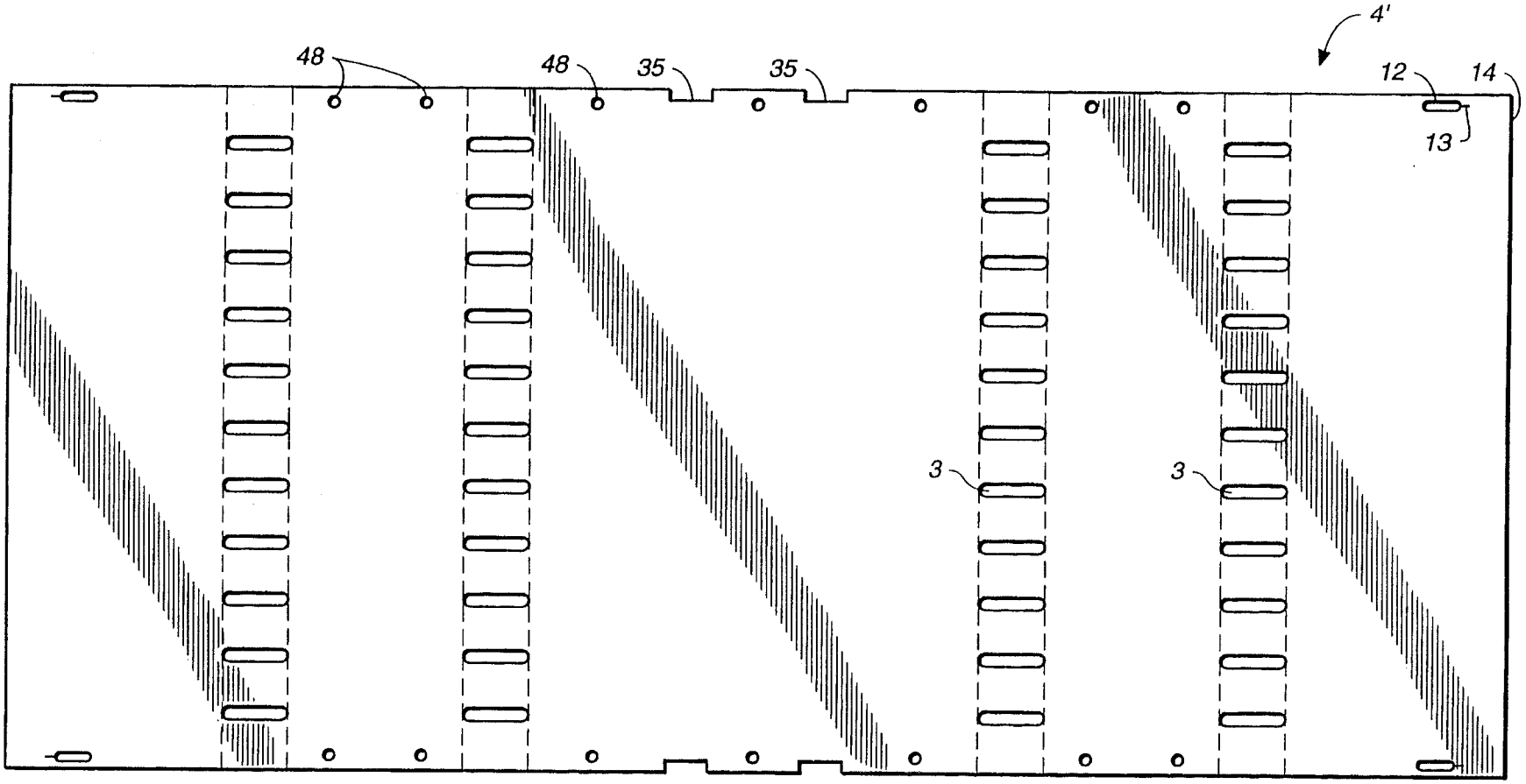
FIG. 3A is a plan view of an alternate embodiment of a panel used to construct the stackable container of the present invention.
Figure 4:
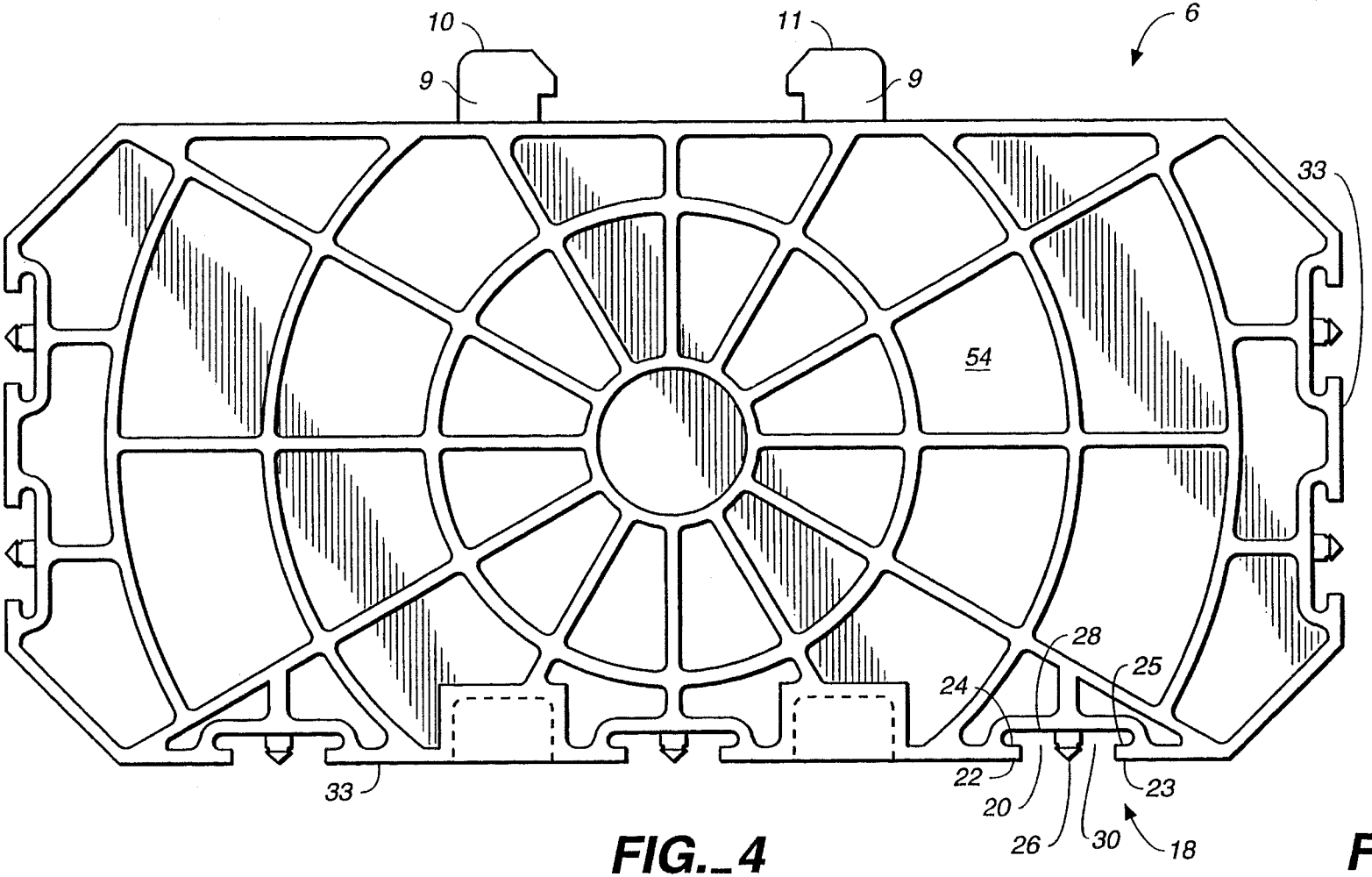
FIG. 4 is an elevational view of one embodiment of an end plate used to construct the stackable container.
Figure 8A:
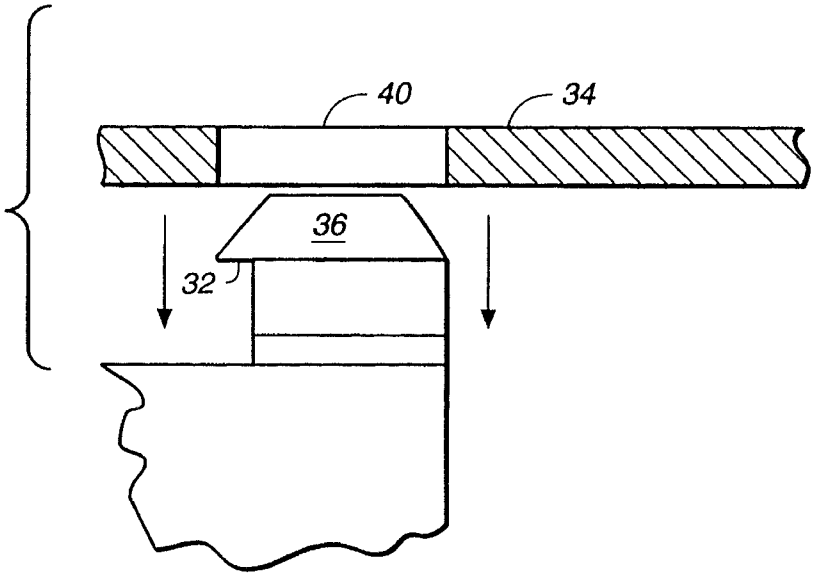
FIGS. 8A and 8B are enlarged, fight-side elevational views showing the tab of FIG. 7 being locked on the protrusion shown in FIG. 6.
Figure 8B:
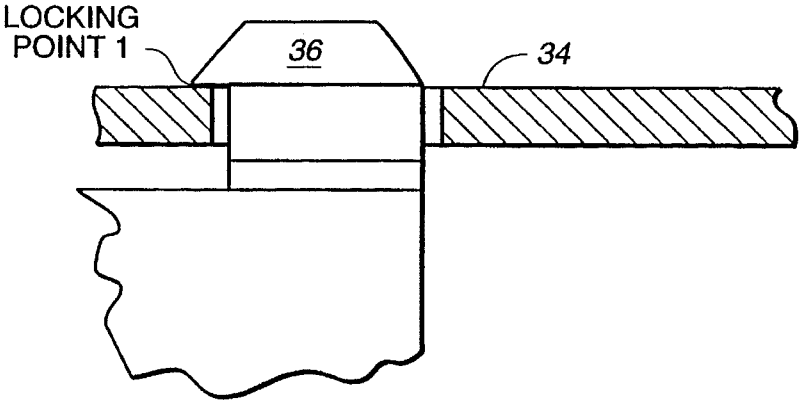
Figure 6:
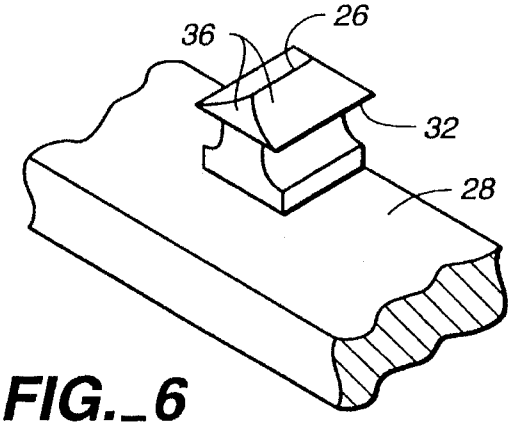
FIG. 6 is an enlarged isometric view of one embodiment of a protrusion extending from the end plate of FIG. 4 used to hold the panel of FIG. 3 on the end plate.
Figure 7:
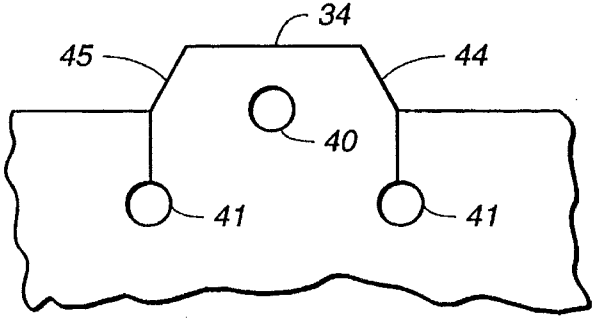
FIG. 7 is an enlarged plan view of one embodiment of a tab located along the edge of the panel shown in FIG. 3.

In one embodiment of the present invention (FIGS. 1 and 2), there is provided a stackable shipping and storing container 2 in accordance with the present invention. The container 2 comprises a panel 4 (FIG. 3) wrapped around two end plates 6,7 (FIG. 4). The vents 3 allow the contents of the container 2 to be force air cooled if necessary. The panel 4 is preferably a corrugated material such as corrugated plastic, fiberboard, paperboard, however non-corrugated materials such as honeycomb-type laminates, thin wood, sheet plastic, or any material sufficiently strong to support the desired weight of the contents of the box without tearing away from the end plate can be used. It is desirable that the panel material also have sufficient flexibility to be attached to the end plate with a novel panel lock which will be described later. A preferable material for the panel is three millimeter corrugated plastic which has a density of 600 grams/$m^2$. It is most desirable to use corrugated plastic with the direction of the flutes in the corrugated plastic extending longitudinally between the end plates 6,7 so as to give greater strength to the container 2 overall and so that the panel 4 will attach stronger to the end plates 6,7. It is contemplated however that the flutes could extend laterally or diagonally across the container 2.

Figure 2:
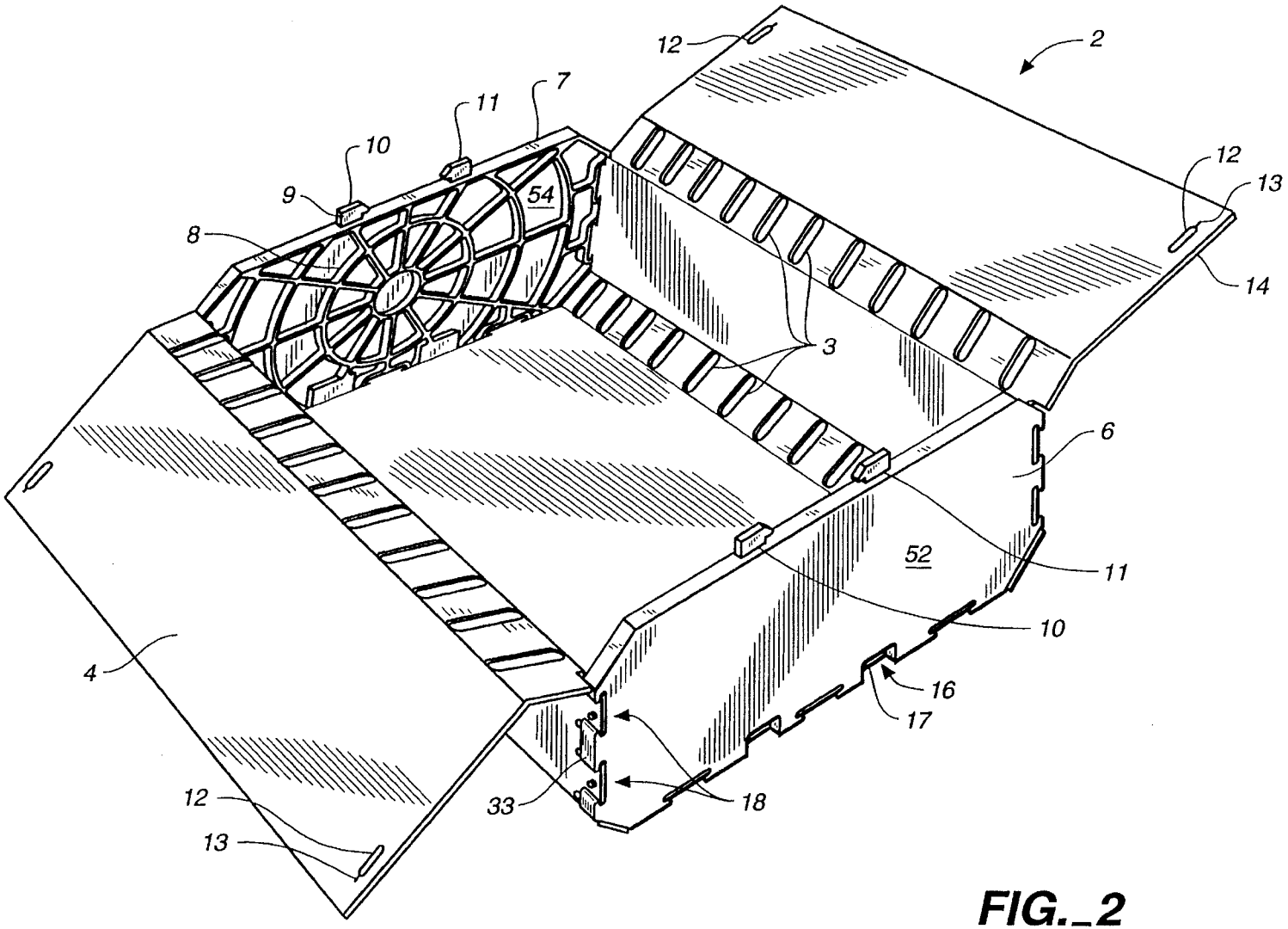
FIG. 2 is an isometric view of the stackable container shown in FIG. 1 with the lid opened.

In one embodiment, the end plates 6,7 are preferably injection molded polypropylene although other plastic materials such as ABS, polystyrene, polycarbonates, and glass filled nylons or non-plastic materials can be used as will be apparent to one of ordinary skill in the art. End plates 6,7 have a circular configuration 8 (i.e., spider web) of reinforcing ribs. Advantageously, the circular configuration 8 provides the greatest strength to the end plates 6,7 with the least amount of material. Square or triangular ribs can be used but the square comers are stress risers and thus do not have as good a stress distribution as the circular configuration when a load is applied to the top of the end plate 6. The circular configuration 8 is shown on the inside surface of the container 2 as best seen in FIG. 2. However, the circular configuration can be on the outside of the container, on both the inside and outside surfaces of the container, in between a smooth inside surface and a smooth outside surface (i.e., a honeycomb design), etc. A plastic or paper liner can be used along the inside of the container 2 to prevent damage to the contents (i.e., bruising of the fruit). Preferably, the panel 4 and the end plates 6,7 are made of similar recyclable materials so that the container 2 can be easily recycled without having to disassemble the container or remove non recyclable fasteners.

Figure 5:
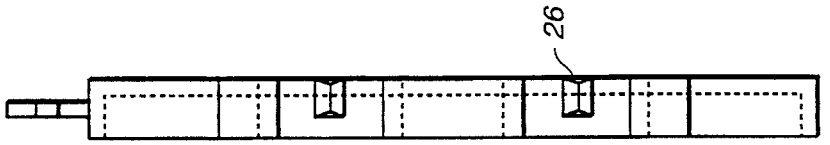
FIG. 5 is a fight-side elevational view of the end plate in FIG. 4.

In one embodiment, the end plates 6,7 have two stacking tabs 10,11 extending from an upper portion of the end plate. As shown in FIG. 5, the stacking tabs 10, 11 extend from the top edge of the end plate 6 but the stacking tab could extend from other locations in the upper portion of the end plate. For example, the tabs could be attached to the inside or outside surface of the end plate. The stacking tabs 10, 11 can have several functions. One function is to receive an opening 12 in a lid portion 14 (i.e., flap) of the panel 4 to hold that portion of the lid closed. The opening 12 preferably has a small cut or slit 13 extending from the end of the opening 12 which allows the lid to be opened and closed more easily and several times without tearing as it moves over the stacking tabs. Preferably, the lid flaps of the container stretch over the stacking tabs to put the panel in tension to create greater rigidity in the container. The container 4 does not have to have a lid.

Figure 11:
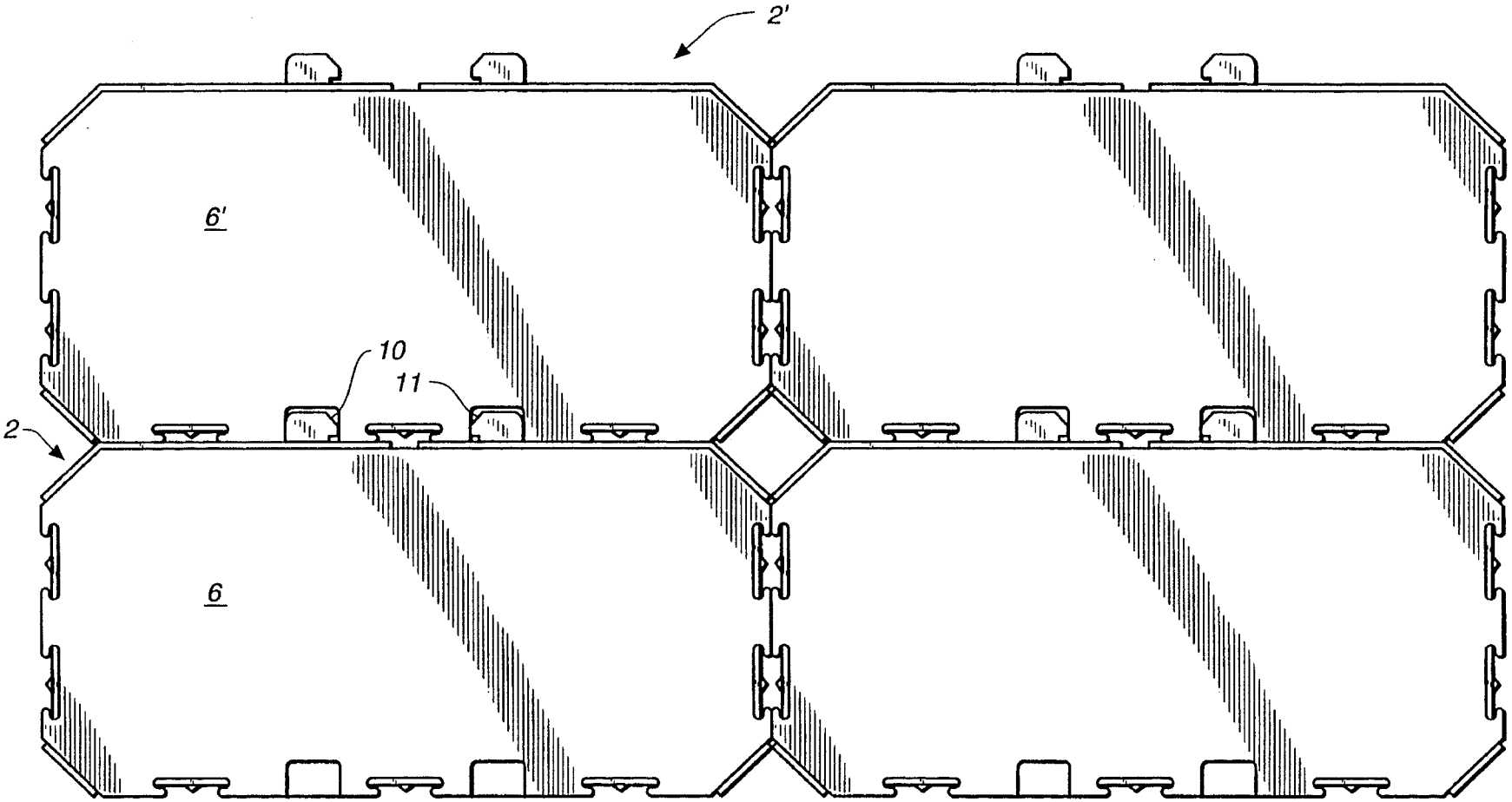
FIG. 11 is an end elevational view of containers of the present invention stacked in accordance with the present invention.

A second function is to extend into an opening 16 in a bottom portion of an end plate 6' in substantially identical container 2' stacked on top of the container 2 (FIG. 11 ). As shown in FIG. 4, the opening 16 is in the bottom edge of the end plate but (as with the stacking tab) it could extend from other locations in the bottom portion of the end plate as long as it aligns with a stacking tab on a corresponding container 2'. The opening 16 has a vertical surface 17 that abuts the inside surface 9 of each of the stacking tabs when container 2' is stacked on top of container 2. In this way, the stacking tabs prevent the container 2' from moving lengthwise across container 2. In a similar manner, the stacking tabs 10,11 of container 2 prevent the container 2' from moving laterally across container 2. The opening 16 can have a vertical surface that abuts the outside surface of each of the stacking tabs. However, it has been found that the embodiment shown in the drawing makes stacking of loaded containers easier.

Figures 9A, 9B, 9C:
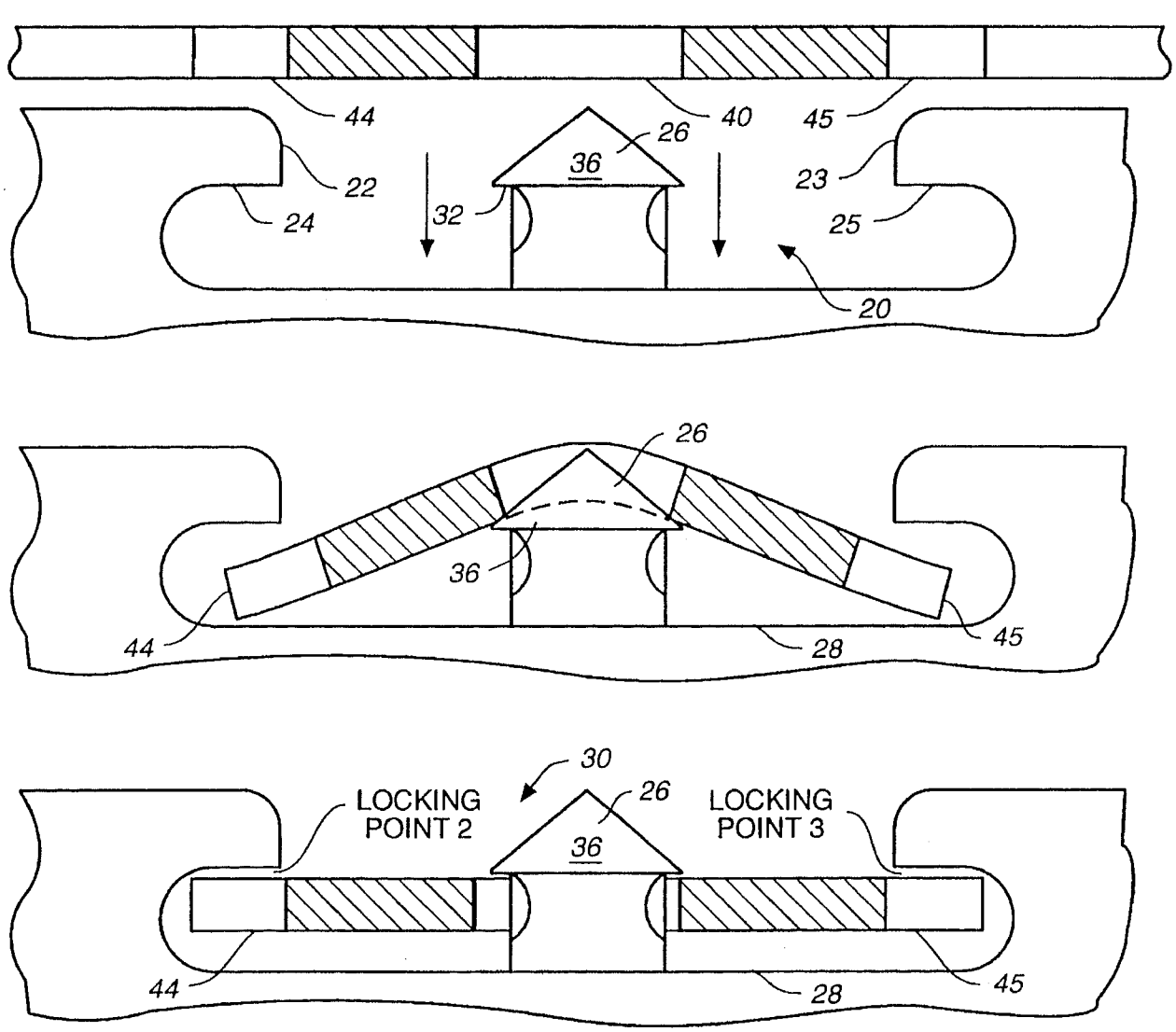
FIGS. 9A, 9B, and 9C are enlarged, front elevational views showing the tab and protrusion of FIGS. 8A and 8B.
Figure 9D:
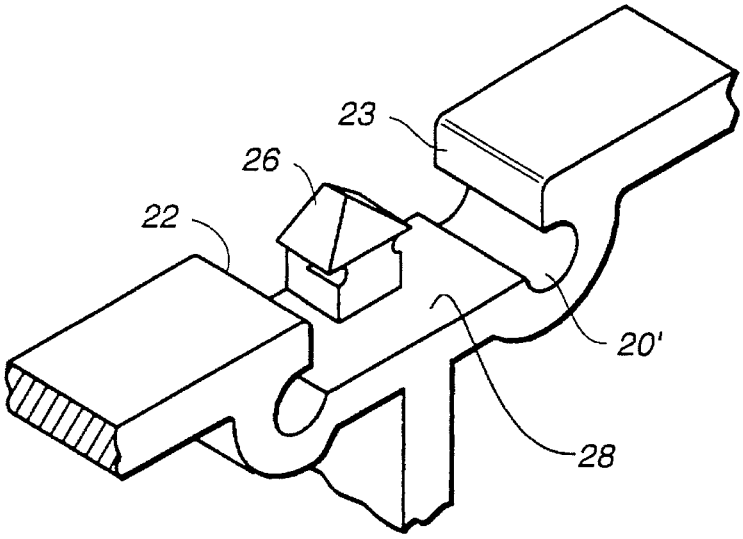
FIGS. 9D and 9E are enlarged views of an alternate embodiment of the locking portion of the end plate in accordance with the present invention.

The panel 4 is attached to the embodiment of end plate 6,7 shown in FIGS. 4 and 5 with the novel panel locks 18. In one embodiment, panel lock 18 comprises a channel 20 (FIG. 9A) extending perpendicularly through the thickness of the end plate 6,7. The channel 20 is generally C-shaped so as to form flanges 22,23 at the edges 24,25 of the channel. A protrusion 26 extends from the back 28 of the channel 20 toward the opening 30 in the channel.

The channel 20 and protrusion 26 form a unique locking mechanism as will be described with reference to FIGS. 6 through 9B. The protrusion 26 in one embodiment has an overhanging edge 32 so that when the panel tab 34 is pressed into the panel lock 18 the panel tab 34 (FIG. 8A) is secured in place under the overhanging edge 32 of the protrusion. That is one locking point or catch point. In addition, when the panel tab 34 is pressed into the panel lock 18 the panel tab 34 is secured in place under the flanges 22,23 of the channel 20. That is two more locking or catch points so that the panel lock is a three point locking mechanism. The panel lock can be more than a three point locking mechanism, for example the channel can have two protrusions and the panel tab can have two openings to go over the protrusions. The protrusion 26 can have sloped top surfaces 36 to facilitate the opening 40 in the panel tab 34 being pushed over the protrusion 26. Preferably, opening 40 is circular to prevent any cracks from forming or propagating when the opening is pushed over the protrusion, however other shaped (e.g., triangular, hexagonal, etc.) openings can be used. Depending on the material used for the panel 4, the opening 40 may not have to be present and the panel can be forced over the protrusion 26.

The panel tabs 34 along the edge of the panel 4 (FIG. 3) have tapered ends to facilitate the panel tabs 34 being pushed under the flanges 22,23 of each panel lock 18. The panel tabs 34 can also have openings 41 to provide stress relief when the panel tab 34 is pressed into the panel lock 18. The circular openings 41 prevent cracks from forming or propagating. Panel 4 has a plurality of notches 35 which correspond to the edge portions 33 around the end plates 6,7 and the openings 16 when the panel is wrapped around the end plates.

Figure 9E:
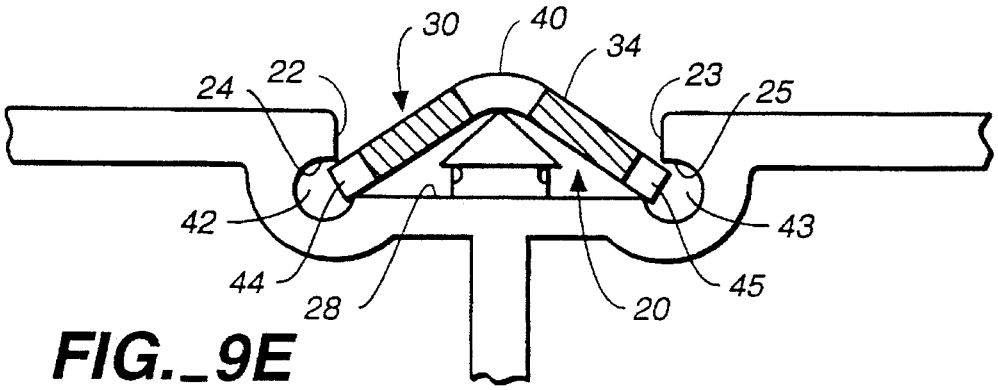

FIG. 9E shows an alternate embodiment in general for the panel lock 18 and specifically for the channel 20. Channel 20' is substantially C-shaped with extended areas 42,43 near the upper and lower sharp curves of the C-shape. When panel tab 34 is bent over and pressed onto protrusion 26 (FIG. 9E), edges 44 and 45 extend into the areas 42 and 43 to allow the panel tab 34 and the opening 40 to be more easily and completely pressed onto the protrusion. The panel locks 18 can also be on the surface 52 on the outside of the container or on the surface 54 on the inside of the container. Of course, the panel 4 would have to be extended or trimmed accordingly to accommodate such a configuration. One particular advantage to the panel locks as shown in FIGS. 4–9E is that they are non-destructive locks. As a result the end plates can be recovered after single or multiple uses of the container, the old panel removed and a new panel attached to create a new container. Likewise, if a panel is damaged during assembly of the container it can be discarded and a new panel attached to the end plate.

Figure 10A:
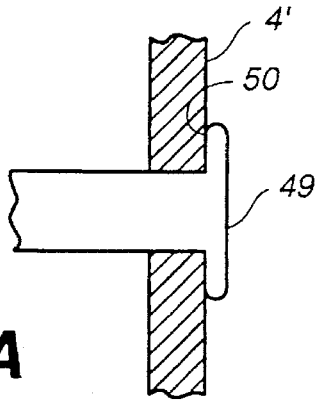
FIG. 10A is an enlarged partial cross-sectional view of the attachment shown in FIG. 10.
Figure 10:
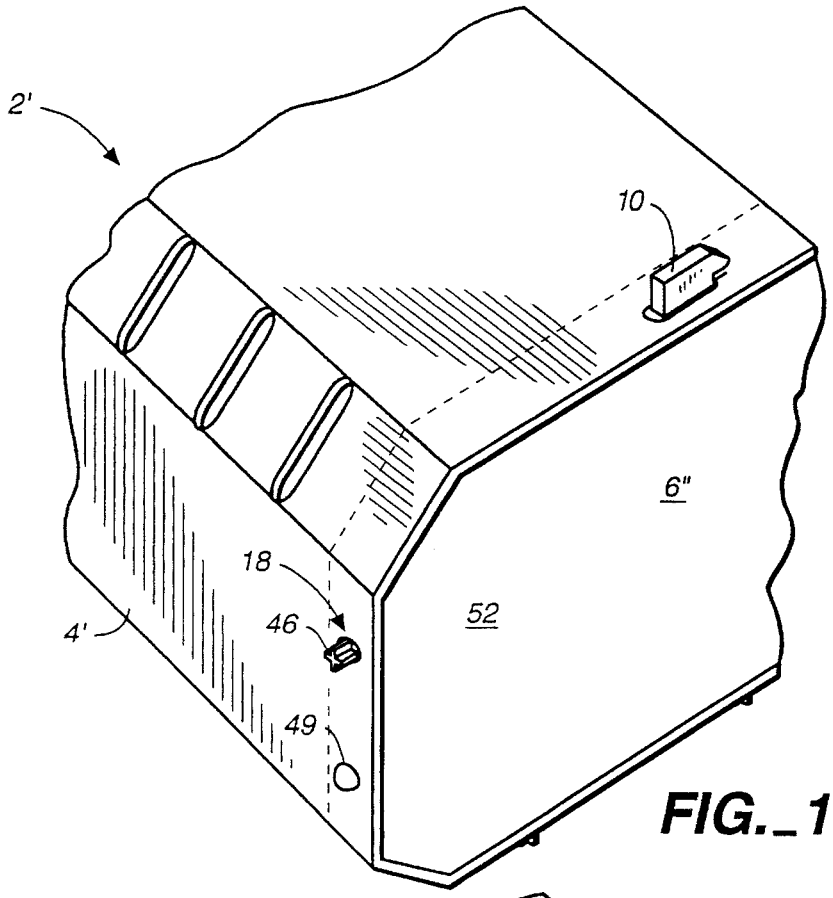
FIG. 10 is a partial isometric view of another embodiment for attaching a panel to an end plate using heat stakes in accordance with the present invention.
Figure 10C:
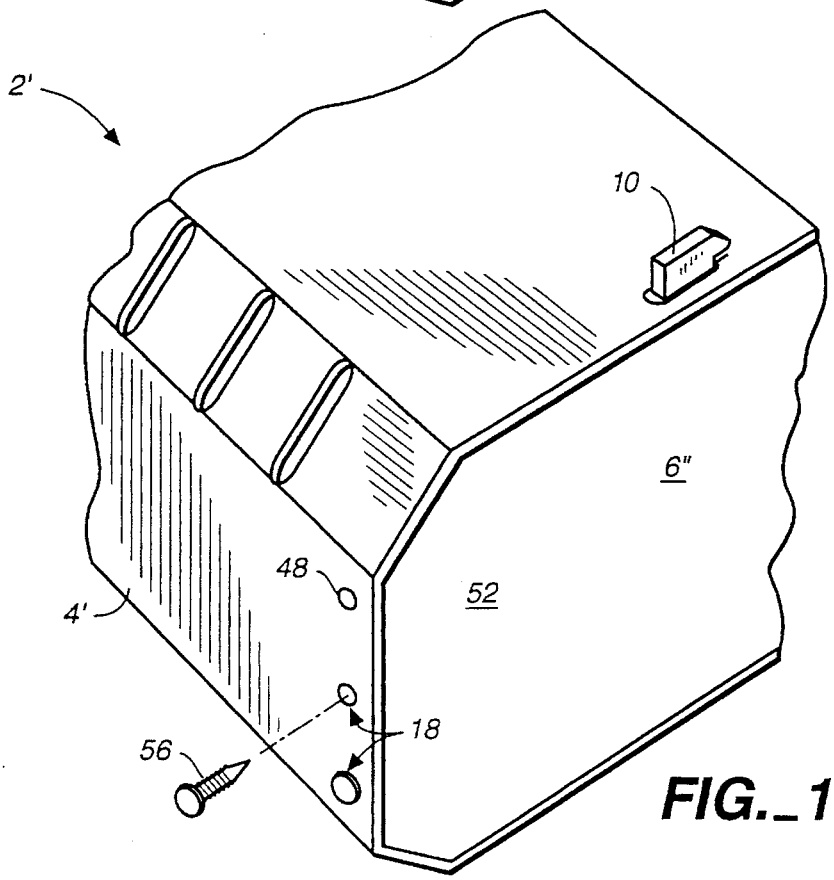
FIG. 10C is a partial isometric view of yet still another embodiment for attaching a panel to an end plate using plastic rivets in accordance with the present invention.
Figure 10B:
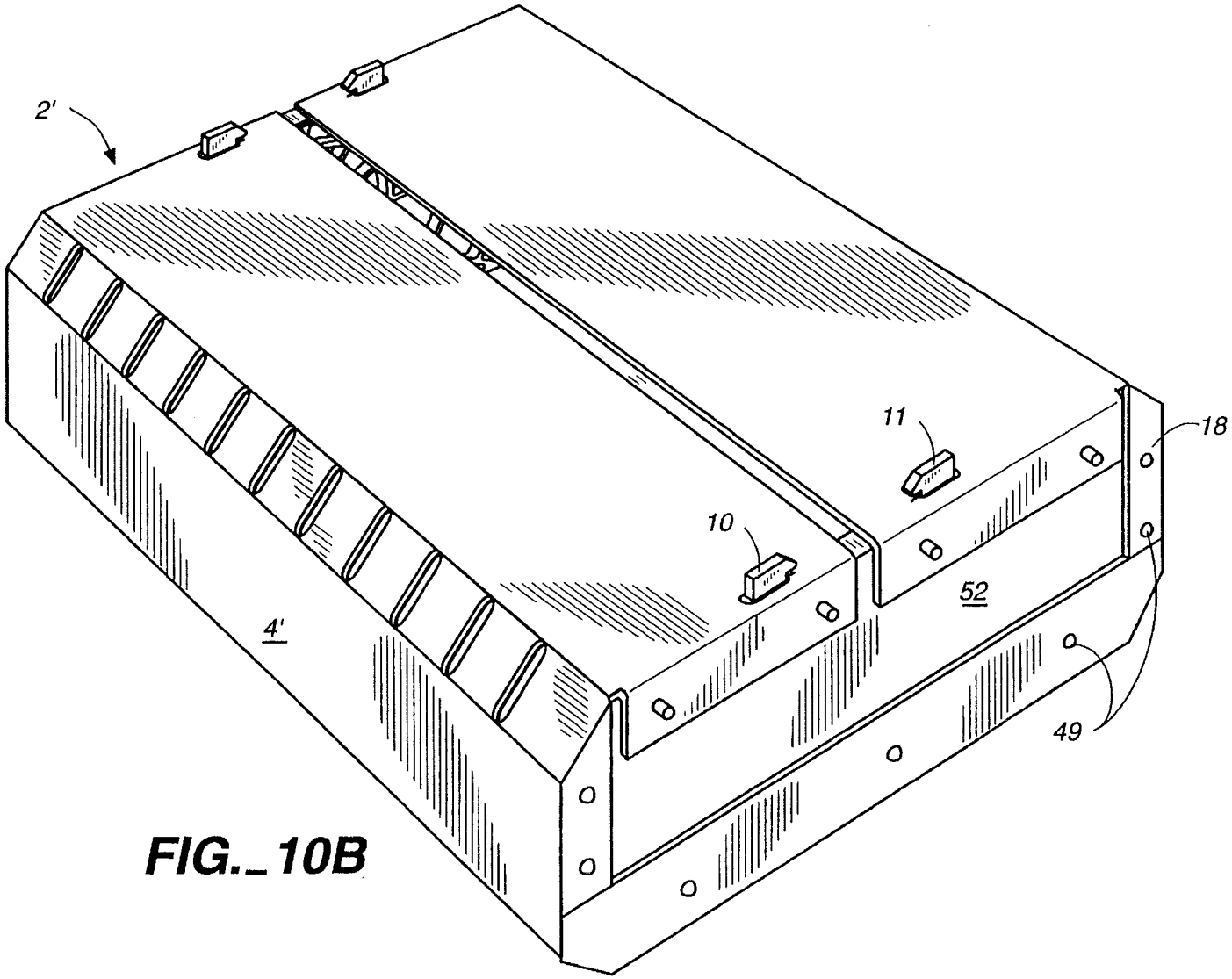
FIG. 10B is an isometric view of yet another embodiment for attaching a panel to an end plate using the outside surface of the end plate in accordance with the present invention.

FIGS. 10 and 10A illustrate an alternate method for attaching the panel to the end plates. End plate 6" has a plurality of posts 46 spaced around its periphery. Panel 4' has a plurality of openings 48 for receiving the posts 46. To attach the panel to the end plates, the panel 4' is wrapped around the end plate 6" with the posts 46 extending through the corresponding openings 48. The posts 46 are then compressed to form a stud 49 (FIG. 10A). The lip 50 formed by compressing the post 46 holds the panel 4' to the end plate. The posts 46 can also be on the surface 52 on the outside of the container (FIG. 10B) or on the surface 54 on the inside of the container. Of course, the panel 4' would have to be extended and/or trimmed accordingly to accommodate such a configuration.

The stud 49 can be formed by many methods as will be apparent to one of ordinary skill in the art. One such method is by using a thermal press which applies heat and pressure to the post 46. Typically, the cross shaped posts as shown in FIG. 10 provide the greatest strength but other configurations can be used such as square, circular, etc. and be either hollow or solid. For best performance, the height of the post 46 above the outer surface of the panel should be 1.5 to 2.0 times the post diameter. Another such method is by ultrasonic welding. A forming sonotrode is placed on the tip of the post 46 and very high amplitude ultrasonics are applied to the tip of the post 46 so that fusion is started by mechanical strength loss in the post. Rivets 56 can also be used to attach the panel 4' to the end plate 6. The rivets 56 (FIG. 10C) should be of similar recyclable material as the end plate and panel so that the container can be recycled without the need for disassembly.

Figure 12A:
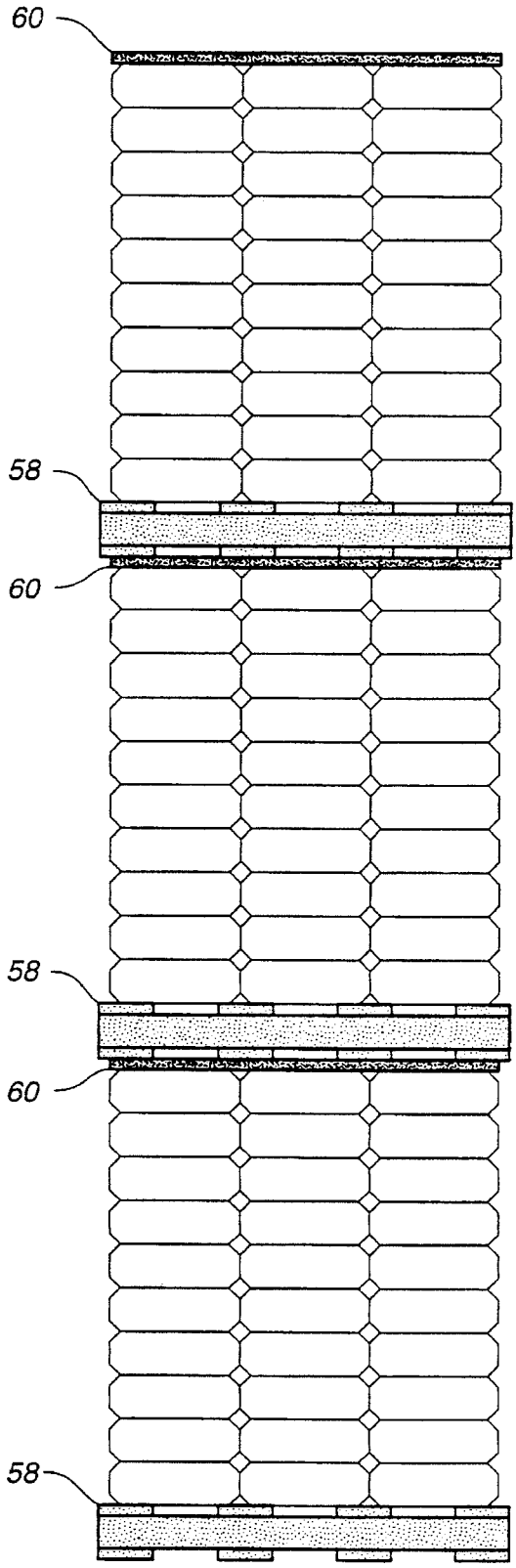
FIGS. 12A and 12B are elevational views of containers of the present invention stacked on palettes in accordance with the present invention.
Figure 12B:
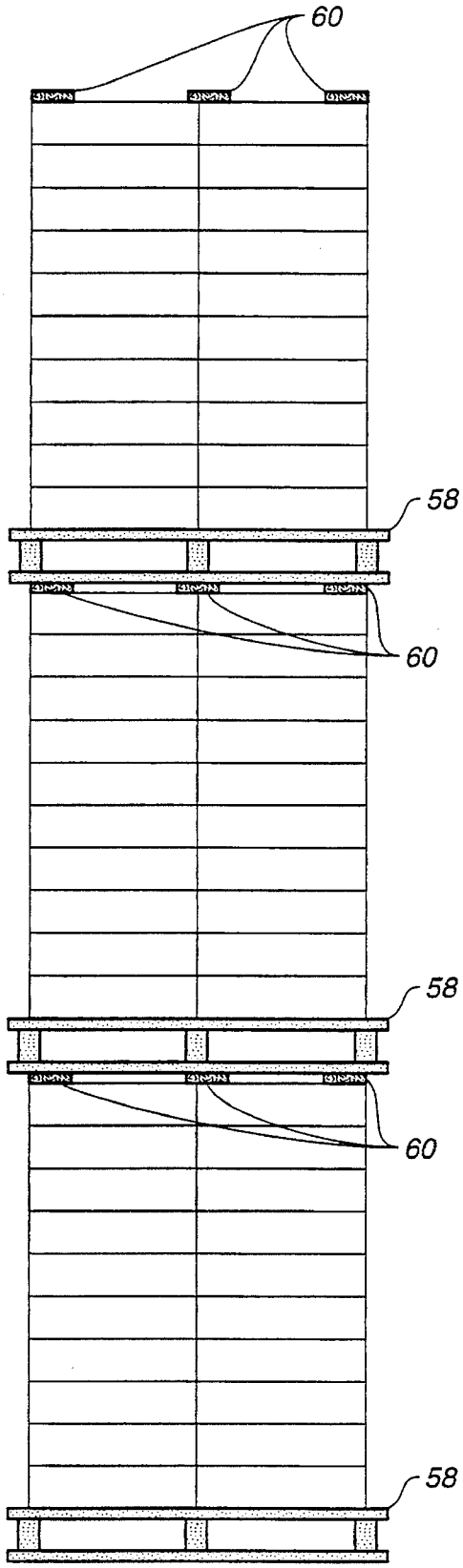
Figure 13A:
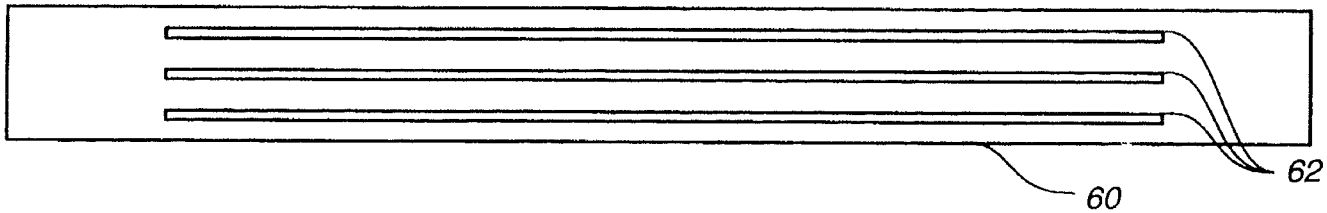
FIG. 13A is a plan view of one embodiment of a holding member for use in accordance with the present invention.
Figure 13C:
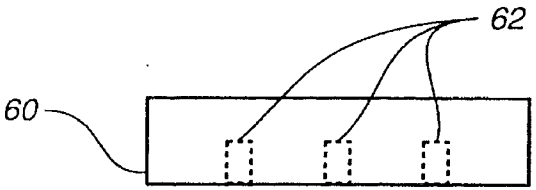
FIG. 13C is an end elevational view of the holding member of FIG. 13A.
Figure 13B:
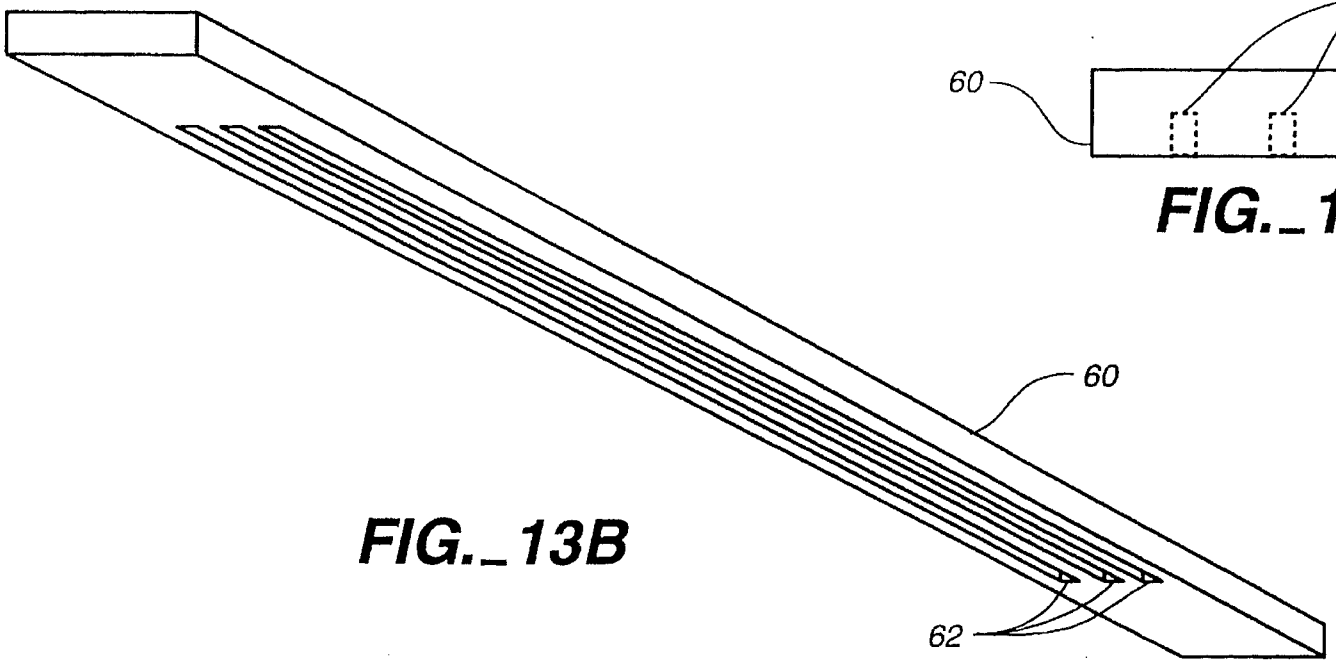
FIG. 13B is an isometric view of the holding member of FIG. 13A.

The end plates 6,7 of the present invention provide sufficient strength for the containers to be stacked fully loaded in quantities of sixty containers (or even ninety containers) per palette 58 with the palettes stacked three high (FIGS. 12A and 12B). Two palettes of ninety containers weighs approximately 4800 pounds. Another function of the stacking tabs 10,11 discussed previously is to receive a stack supporting member 60 (FIGS. 13A–13C). The stack supporting member 60 can be used across the top of the containers stacked on each palette. In one embodiment, the stack supporting member 60 has slots 62 for receiving the stacking tabs 10,11 of the containers on the top of each stacked palette 58. The member 60 can have fewer or more than three slots. Likewise, the slots 62 do not have to extend continuously through the member 60, the slots only need to be long enough to receive the stacking tabs 10,11 of each of the containers. It is advantageous to have the slots 62 offset from the center of the member 60 so that when the member is in place across the containers a portion of the member does not extend past the edge of the containers. In this way, the member 60 will not catch on a loaded palette as it is being loaded by a forklift operator on top of another palette.

As shown in FIG. 12B, three members are used across the containers stacked on each palette 58. The stack supporting members 60 are not necessary for stacking the containers and palettes but when used they help to prevent the stacks from shifting or leaning during movement of the loaded palettes. The member 60 holds one column of stacked containers to the next column of stacked containers for increased stability to both columns. In addition, the stack supporting members 60 act as skids for receiving a loaded palette on top of a stack of containers on a palette. The stack supporting members 60 protect the stacking tabs 10,11 from breaking when another palette is slid across the tops of the containers. Twine, rope or some other kind of strap can be wrapped underneath the loaded palette and over the stack supporting members to hold the columns of containers.

The foregoing has described the principles, preferred embodiments and modes of operation of the present invention. However, the invention should not be construed as being limited to the particular embodiments discussed. Thus, the above-described embodiments should be regarded as illustrative rather than restrictive, and it should be appreciated that variations may be made in those embodiments by workers skilled in the art without departing from the scope of the present invention as defined by the following claims.

What is claimed is:

1. A stackable shipping and storing container, comprising:

a first end plate having a stacking tab extending vertically from a top of the first end plate, having a receiving slot at a bottom of the first end plate for receiving a stacking tab of a substantially identical second stackable container, and having a plurality of first panel locks, at least one first panel lock being on each of a first edge, a third edge, and a second edge of the first end plate, each of said first panel locks not extending beyond a perimeter of the first end plate;

a second end plate having a stacking tab extending vertically from a top of the second end plate, having a receiving slot at a bottom of the second end plate for receiving a stacking tab of a substantially identical second stackable container, and having a plurality of second panel locks, at least one second panel lock being on each of a first edge, a third edge, and a second edge of the second end plate, each of said second panel locks not extending beyond a perimeter of the second end plate; and a panel having a plurality of first panel tabs at a first end for attaching the panel to the first end plate with the plurality of first panel locks and a plurality of second panel tabs at a second end for attaching the panel to the second end plate with the plurality of second panel locks, each of said first panel tabs and said second panel tabs being pressed perpendicular to each respective edge of the respective end plates into engagement with each of said respective panel locks.

2. The stackable container of claim 1 wherein:

each of the first panel locks and the second panel locks comprises a channel extending perpendicularly through the thickness of the end plate, the channel being generally C-shaped so as to form flanges, the channel having a protrusion extending from a back of the channel toward an opening in the channel formed between the flanges, the protrusion having an overhanging edge so that when each of the first panel tabs and the second panel tabs is pressed into each of the first panel locks and the second panel locks respectively each of the first panel tabs and second panel tabs is secured in place under the flanges of the channel and under the overhanging edge of the protrusion.

3. The stackable container of claim 1 wherein each of the first panel locks and the second panel locks comprises a protrusion having an overhanging edge so that when each of the first panel tabs and the second panel tabs is pressed over the protrusion each of the first panel tabs and the second panel tabs is secured in place under the overhanging edge of the protrusion.

4. The stackable container of claim 1 wherein the end plates have a circular set of reinforcing ribs.

5. The stackable container of claim 1 wherein the panel further comprises a flap having a first slot at a first end for receiving the stacking tab of the first end plate therethrough and a second slot at a second end for receiving the stacking tab of the second end plate therethrough to hold the flap closed.

6. The stackable container of claim 5 wherein the flap stretches over each of the stacking tabs to put the panel in tension to create greater rigidity in the container.

7. The stackable container of claim 1, further comprising: holding means for holding a stack of substantially identical stackable containers to a second stack of substantially identical containers.

8. The stackable container of claim 7, wherein the holding means comprises a member having a slot adapted to receive a first stacking tab on the stack of stackable containers and a second stacking tab on the second stack of substantially identical containers.

9. A stackable shipping and storing container, comprising:

a first end wall;

a second end wall;

a right side wall extending between the first end wall and the second end wall and having a locking tab near each of a first end and a second end;

a left side wall extending between the first end wall and the second end wall and having a locking tab near each of a first end and a second end;

a bottom wall extending between the first end wall and the second end wall and having a locking tab near each of a first end and a second end; and locking means for attaching each locking of the right side wall, the left side wall, and the bottom wall to the first end wall and the second end wall wherein each locking tab is held in the locking means at at least three points by pressing each of the locking tabs perpendicularly into engagement with the locking means.

10. The stackable container of claim 9, wherein each of the first end wall and the second end wall have an upwardly extending stacking tab, the stacking tab being adapted to be received in an opening provided in a bottom of each of a first end wall and a second end wall of a second stackable container stacked on top of the stackable container to prevent relative movement of the stackable container and the second stackable container.

11. The stackable container of claim 10 further comprising a top wall, at least a first portion of the top wall being hingedly attached to the left side wall and a second portion of the top wall being hingedly attached to the right side wall, said first portion and said second portion each having a slot at each of their respective ends adapted to receive the stacking tab of each of the respective end walls so that the top wall is held closed by each of the stacking tabs.

12. The stackable container of claim 9 wherein the first end wall and the second end wall comprise a circular web of reinforcing ribs to provide strength to the container for stacking wherein compressive forces on the stackable container are borne by the first end wall and the second end wall to prevent compression of the contents of the stackable container.

13. The stackable container of claim 9 wherein the left side wall, the right side wall, and the bottom wall are formed from a single panel wrapped around a perimeter of the first end wall and the second end wall.

14. The stackable container of claim 13 wherein the panel is corrugated material having longitudinal flutes that extend substantially horizontally from the first end wall to the second end wall.

15. The stackable container of claim 9 wherein the locking means comprises a channel extending perpendicularly through the thickness of the end plate, the channel being generally C-shaped so as to form flanges, the channel having a protrusion extending from a back of the channel toward an opening formed between the flanges in the channel, the protrusion having an overhanging edge so that when each of the locking tabs is pressed into the locking means each of the locking tabs is secured in place under the flanges of the channel and under the overhanging edge of the protrusion.

16. The stackable container of claim 9 wherein the locking means are on a first edge, a bottom edge, and a second edge of the first end wall and the second end wall.

17. The stackable container of claim 9 wherein the locking means are on a surface of the first end wall and the second end wall that is generally perpendicular to an edge on each of the first end wall and the second end wall.

18. A stackable shipping and storing container, comprising:

a first end wall having a stacking tab extending vertically from a top of the first end wall, having a receiving slot at a bottom of the first end wall for receiving a stacking tab of a substantially identical second stackable container, and having at least one protrusion near each of a first edge, a bottom edge, and a second edge of the first end wall;

a second end wall having a stacking tab extending vertically from a top of the second end wall, having a receiving slot at a bottom of the second end wall for receiving a stacking tab of a substantially identical second stackable container, and having at least one protrusion near each of a first edge, a bottom edge, and a second edge of the second end wall;

a left side wall having an opening at a first end and a second end, the protrusion near the first edge of the first end wall protruding through the opening at the first end of the left side wall and being compressed after protruding through the opening to secure the left side wall to the first end wall, the protrusion near the first edge of the second end wall protruding through the opening at the second end of the left side wall and being compressed after protruding through the opening to secure the left side wall to the second end wall;

a bottom wall having an opening at a first end and a second end, the protrusion near the bottom edge of the first end wall protruding through the opening at the first end of the bottom wall and being compressed after protruding through the opening to secure the bottom wall to the first end wall, the protrusion near the bottom edge of the second end wall protruding through the opening at the second end of the bottom wall and being compressed after protruding through the opening to secure the bottom wall to the second end wall; and a fight side wall having an opening at a first end and a second end, the protrusion near the second edge of the first end wall protruding through the opening at the first end of the right side wall and being compressed after protruding through the opening to secure the right side wall to the first end wall, the protrusion near the second edge of the second end wall protruding through the opening at the second end of the right side wall and being compressed after protruding through the opening to secure the right side wall to the second end wall.

19. The stackable container of claim 18 wherein the protrusions are on the first edge, the bottom edge, and the second edge of the first end wall and the second end wall.

20. The stackable container of claim 18 wherein each of the protrusions of the first end wall is on a surface of the first end wall that is generally perpendicular to the first edge, second edge and bottom edge of the first end wall and each of the protrusions of the second end wall is on a surface of the second end wall that is generally perpendicular to the first edge, second edge and bottom edge of the second end wall.

21. The stackable container of claim 18 wherein a distal end of each of the protrusions is flattened to secure the right side wall, the bottom wall and the left side wall to the first end wall and the second end wall.

22. The stackable container of claim 18 wherein the protrusions have an overhanging edge so that when the openings in the right side wall, the bottom wall, and the left side wall are pressed over the protrusions the right side wall, the bottom wall, and the left side wall are secured in place under the overhanging edge of the protrusion.

23. A stackable shipping and storing container, comprising:

a first end plate having a stacking tab extending vertically from a top of the first end plate, having a receiving slot at a bottom of the first end plate for receiving a stacking tab of a substantially identical second stackable container, and having a plurality of first panel locks, at least one first panel lock being on a first edge, a bottom edge, and a second edge of the first end plate;

a second end plate having a stacking tab extending vertically from a top of the second end plate, having a receiving slot at a bottom of the second end plate for receiving a stacking tab of a substantially identical second stackable container, and having a plurality of second panel locks, at least one second panel lock on a first edge, a bottom edge, and a second edge of the second end plate; and a panel having a plurality of first panel tabs at a first end for attaching the panel to the first end plate with the plurality of first panel locks and a plurality of second panel tabs at a second end for attaching the panel to the second end plate with the plurality of second panel locks, each of said first panel locks and said second panel locks comprises a channel extending perpendicularly through the thickness of the end plate, the channel being generally C-shaped so as to form flanges, the channel having a protrusion extending from a back of the channel toward an opening in the channel formed between the flanges, the protrusion having an overhanging edge so that when each of the first panel tabs and the second panel tabs is pressed into each of the first panel locks and the second panel locks respectively each of the first panel tabs and second panel tabs is secured in place under the flanges of the channel and under the overhanging edge of the protrusion.

24. The stackable container of claim 23 wherein the end plates have a circular set of reinforcing ribs.

25. The stackable container of claim 23 wherein the panel further comprises a flap having a first slot at a first end for receiving the stacking tab of the first end plate therethrough and a second slot at a second end for receiving the stacking tab of the second end plate therethrough to hold the flap closed.

26. The stackable container of claim 23, further comprising:

holding means for holding a stack of substantially identical stackable containers to a second stack of substantially identical containers.

* * * * *